US005767625A

United States Patent [19]

Shrader et al.

[11] Patent Number: 5,767,625

[45] Date of Patent: *Jun. 16, 1998

[54] HIGH FREQUENCY VACUUM TUBE WITH CLOSELY SPACED CATHODE AND NON-EMISSIVE GRID

[75] Inventors: Merrald B. Shrader, Buena Vista, Colo.; Andrew A. Haase, Redwood City, Calif.

[73] Assignee: Communications & Power Industries, Inc., Palo Alto, Calif.

[ * ] Notice: The term of this patent shall not extend beyond the expiration date of Pat. No. 5,572,092.

[21] Appl. No.: 632,589

[22] Filed: Apr. 15, 1996

Related U.S. Application Data

[63] Continuation-in-part of Ser. No. 69,705, Jun. 1, 1993, Pat. No. 5,572,092.

[51] Int. Cl.[6] ..... H01J 25/02

[52] U.S. Cl. ..... 315/5.37; 313/293; 313/447; 330/44

[58] Field of Search ..... 315/5.33, 5.37, 315/5.44, 5.52, 5.53, 5.54; 330/44, 45; 313/293, 447

[56] References Cited

U.S. PATENT DOCUMENTS

| | | | |
|---|---|---|---|
| 2,515,997 | 7/1950 | Haeff | 315/5.37 X |
| 2,579,820 | 12/1951 | Haller et al. | 330/45 X |
| 2,634,383 | 4/1953 | Gurewitsch | 315/5.52 X |
| 2,840,753 | 6/1958 | Dailey | 315/5.53 X |
| 2,857,480 | 10/1958 | Mihran et al. | 330/45 |
| 2,945,158 | 7/1960 | Carson | 315/5.37 X |
| 4,119,921 | 10/1978 | Warringa et al. | 330/45 X |
| 4,480,210 | 10/1984 | Preist et al. | 315/4 |
| 4,494,039 | 1/1985 | Kim | 315/4 |
| 4,527,091 | 7/1985 | Preist | 315/5 |
| 4,607,242 | 8/1986 | Cozzie | 333/208 X |
| 4,611,149 | 9/1986 | Nelson | 315/5.39 |
| 4,705,988 | 11/1987 | Tran et al. | 315/4 |
| 4,905,086 | 2/1990 | Tahara | 330/44 X |
| 5,187,408 | 2/1993 | Jödicke et al. | 315/5 |
| 5,233,269 | 8/1993 | Lien | 315/5.37 |
| 5,281,923 | 1/1994 | Heppinstall | 330/45 |
| 5,317,233 | 5/1994 | Lien et al. | 315/5.37 |

FOREIGN PATENT DOCUMENTS

| | | |
|---|---|---|
| 2 243 943 | 11/1991 | United Kingdom . |
| 2 259 708 | 3/1993 | United Kingdom . |

OTHER PUBLICATIONS

Preist, et al., "The Klystrode –An Unusual Transmitting Tube with Potential for UHF–TV", Proceedings of the IEEE, vol. 70, No. 11, Nov. 1992, pp. 1318–1325.

*Primary Examiner*—Robert Pascal
*Assistant Examiner*—Justin P. Bettendorf
*Attorney, Agent, or Firm*—D'Alessandro & Ritchie

[57] ABSTRACT

A vacuum tube for handling an r.f. signal having a predetermined frequency range comprises a cathode, a heater, and a non-electron emissive grid. The grid is positioned from the cathode by the distance an emitted electron from the cathode can travel in a quarter cycle of the r.f. signal. Outer and inner metal tubes forming a resonant line of a signal coupler are respectively connected to the grid and cathode. R.F. absorbers absorb r.f. fields in an interaction region between an anode and the grid. In one embodiment a coupling loop is between metal tubes at an end of the tubes spaced $n\lambda/4$ from the grid and cathode. In a second embodiment the coupler includes a coaxial line having an inner conductor connected to a first metal face, spaced from a second opposed metal face by a solid dielectric. An outer conductor is connected to a third metal face, spaced from a fourth opposed metal face by the dielectric. The third and fourth faces surround the first and second faces. The first and third faces are at ground potential while the second and fourth faces are at high negative DC voltages. The second and fourth faces are respectively at common ends of interior and exterior coaxial metal tubes forming a $\lambda/2$ coupler. Hollow inductive structures extend between the inner and outer metal tubes and at different locations along the tubes. Bias leads may be inserted into the inductive structures for shielding.

13 Claims, 9 Drawing Sheets

HIGH FREQUENCY VACUUM TUBE WITH CLOSELY SPACED CATHODE AND NON-EMISSIVE GRID

CROSS-REFERENCE TO RELATED APPLICATION

This application is a continuation-in-part of co-pending application Ser. No. 08/069,705 filed Jun. 1, 1993 now U.S. Pat. No. 5,572,092 in the name of Merrald B. Shrader and entitled "High Frequency Vacuum Tube With Closely Spaced Cathode And Non-Emissive Grid" and commonly assigned herewith to Communications and Power Industries, Inc. and incorporated herein by reference.

Field of the Invention

The present invention relates generally to high frequency vacuum tubes including a cathode closely spaced to a non-emissive grid coupled via a resonant structure to an r.f. signal to be amplified and more particularly to such a tube with at least one of (1) an r.f. field absorbing material substantially surrounding an interaction region between the grid and an accelerating anode, (2) a loop between a pair of coaxial resonant tubes coupling the signal to the grid and cathode, (3) capacitive coupling to a pair of coaxial resonant tubes coupling the signal to the grid and cathode, (4) bias leads for the grid and cathode respectively connected to outer and inner resonant coaxial metal r.f. coupling tubes at a point $n_1\lambda/4$ from the grid and cathode, in combination with a heater lead extending through the inner tube at a point $n_1\lambda/4$ from the grid and cathode, where $n_1$ is an odd integer and $\lambda$ is the wavelength of the r.f. signal supplied to the grid and cathode by the inner and outer tubes, or (5) bias leads required for tube operation being shielded by hollow inductive tuning elements extending between the inner and outer tubes of the resonant input structure.

Background Art

A recently developed vacuum tube for handling r.f. signals includes a cathode for emitting a linear electron beam, a grid positioned parallel and in close proximity to the cathode (no farther than the distance an emitted electron can reach in a quarter cycle of a signal being handled by the tube) for current modulating the beam, and a cavity resonant to the frequency of the signal positioned between the grid and a collector electrode for the beam. The grid is coupled by a structure resonant to the frequency being handled by the tube to an input of the tube. Very high efficiency is achieved with such a tube by biasing the grid so current flowing from the cathode toward the grid occurs for no more than one half cycle of the r.f. signal handled by the tube. The grid is formed of a non-electron emissive material, such as pyrolytic graphite or molybdenum.

In one prior art configuration, a resonant input circuit supplies electric fields in opposing phase between the cathode and grid and between the grid and an accelerating anode positioned between the grid and an output cavity. In another prior art device, a second resonant cavity positioned between the output cavity and the accelerating anode is adjusted so the resonant frequency thereof is above the frequency being handled by the tube, to increase the average efficiency of the tube. These prior art structures are disclosed in the commonly assigned U.S. Pat. Nos. 4,480,210, 4,527,091 and 4,611,149. Other patents generally dealing with similar tubes are U.S. Pat. No. 5,317,233 and U.S. Pat. No. 5,233,269.

Commercially available tubes of this type have included a resonant structure for coupling the input signal to the cathode-grid assembly in the form of a resonant cavity coaxial with the cathode and the electron beam emitted from it. This resonant cavity has a length in the direction of the beam axis that is nominally either a half or full wavelength at the frequency handled by the tube. In practice, it is most usually at the full wavelength of the frequency handled by the tube, causing the tube to have a relatively long length. The input signal to the cavity is capacitive-coupled to the cavity. A metal structure in the input resonant cavity couples the field established in the cavity in response to the input signal to the grid. An r.f. electric field is thereby established between the grid and cathode, to current-modulate the electron beam. An r.f. field is also established in opposing phase between the grid and anode.

Regeneration and increased gain are obtained in the prior art tubes by energy transfer between a pre-bunched beam and an r.f. field in the grid-anode space. To achieve this regeneration and increased gain, a driver circuit for the prior art tubes becomes electrically complex and difficult to design. Considerable time and effort for empirical design of the driver circuit and tube are necessary to achieve the desired results. It is difficult to adjust the driver cavity and tube parameters to achieve the optimum relative intensity and phase relation of the electric fields in the two r.f.-field regions. It is usually necessary to provide numerous tuning stubs and/or other variable resonant structures to provide the optimum relation.

Electrons leaving the grid and accelerated toward the anode are bunched while traversing an interaction region between the grid and cathode. Any impedance presented to the electrons by either free space or resonant modes in surrounding metal or dielectric containers causes r.f. radiation and/or oscillation. This reduces the tube power gain or interferes with other equipment. Previously this problem was handled by reducing the r.f. grid-anode gap impedance substantially to zero by bypassing it with a blocking capacitor or by connecting the grid-anode gap to low impedance coaxial or strip line open-ended resonant by-pass circuits. Whatever approach is taken, full beam voltage, e.g. 32 kV or 85 kV, appears across the gri-danode gap and must be considered, as must the r.f. voltage. The blocking capacitor or by-pass circuit must be in a potting compound to minimize and preferably eliminate high voltage, D.C. arcing.

There are several disadvantages in connecting the blocking capacitor or by-pass circuit between the grid and anode. Potting of the high voltage capacitors and other type of by-pass circuits capable of handling 32 or 85 kV is a problem; reliable arc-free operation is difficult to obtain. In addition, power gain is reduced because the potting compound is lossy. While tuning the grid-anode gap with open resonant lines makes voltage isolation relatively easy, such structures require extra space, tuning procedure and controls.

It is accordingly an object of the present invention to provide a new and improved electron beam vacuum tube including closely spaced cathode and non-emissive grid electrodes employing a relatively simple resonant structure for coupling an r.f. signal between these electrodes.

Another object of the present invention is to provide a new and improved electron beam vacuum tube including closely spaced cathode and non-emissive grid electrodes having an improved structure for reducing r.f. fields in a gap between the grid and a high voltage accelerating anode.

An additional object is to provide a new and improved electron beam vacuum tube including closely spaced cathode and non-emissive grid electrodes that is easily tuned over a wide frequency range, e.g. the U.H.F. spectrum.

A further object is to provide a new and improved input coupling structure for electron beam vacuum tubes including closely spaced cathode and non-emissive grid electrodes.

An added object of the present invention is to provide a new and improved electron beam vacuum tube including closely spaced cathode and non-emissive grid electrodes having an improved structure for minimizing r.f. coupling to leads for supplying grid bias, cathode bias and heater current to the tube.

Summary of the Invention

In accordance with one aspect of the present invention a vacuum tube of the foregoing type includes r.f. absorbing material coupled to an interaction region between the anode and non-emissive grid. The absorbing material absorbs r.f. fields derived in the interaction region in response to a signal having a predetermined frequency range supplied to the grid-cathode structure by a coupler so there is non-regenerative coupling of the signal to the grid-cathode assembly to simplify tube design and tuning.

The absorbing material eliminates the need for a blocking capacitor or the resonant by-pass circuits and the disadvantages associated therewith since the absorbing material substantially prevents reflection of resonant r.f. fields back to the interaction region. In the preferred embodiment, the coupling means includes an input cavity resonant to the frequency of the signal for achieving the correct phase relation between the grid and cathode.

In one preferred embodiment, the coupler includes a loop in a space between inner and outer coaxial metal signal coupling tubes having a length of about $n\lambda/4$between the grid and loop, where $\lambda$ is the wavelength of a frequency in the band, and n is an odd integer. The inner and outer tubes are respectively electrically connected to the cathode and grid. The grid and outer coaxial tube are DC isolated from the cathode and inner coaxial tube, enabling a DC bias voltage to be applied between grid and cathode and the cathode to be at a high negative DC voltage (e.g., −85 kV or −32 kV) relative to the preferably grounded anode. Preferably a DC bias connection is provided for the grid on the outer tube at a position $n_1\lambda/4$ from the grid, where $n_1$ is an odd integer less than n; this position minimizes the r.f. voltage coupled to a source of the DC bias.

In other embodiments, the coupler includes a grounded coaxial cable having inner and outer conductors connected to the signal source. The inner conductor is connected to first metal face spaced from a second opposed metal face by a solid dielectric. The outer conductor is connected to a third metal face spaced from a fourth opposed metal face by the solid dielectric. The third and fourth faces respectively surround the first and second faces. The dielectric extends beyond the periphery of the metal faces so a substantial DC voltage can be established between the faces; the first and third faces are at DC ground potential while the second and fourth faces are at high negative DC voltages. The second and fourth faces are respectively at common ends of interior and exterior coaxial metal tubes forming a half-wavelength coaxial coupler. The other ends of the interior and exterior tubes are respectively connected to the cathode and grid.

For wide bandwidth applications, e.g., transmitters of different UHF television stations, the coupler resonant frequency can be changed substantially. One way of varying the coupler resonant frequency is to form the coupler as a pair of variable length concentric meal tubes that are electrically insulated from each other; fine tuning is provided by a capacitor plate transversely movable between the tubes.

In another arrangement, a secondary cavity is electromagnetically coupled to the coupler. A shorting plunger in the secondary cavity is translated to effectively change the electrical length of the secondary cavity and the coupler resonant frequency.

In yet a further arrangement, the tubes are fixed in position and have a fixed length. Metal fingers, functioning as inductive elements extending between the inner and outer tubes, are positioned at different places along the lengths of the tubes to change the coupler resonant frequency.

In the most preferred arrangement, the tubes are also fixed in position and have a fixed length. To change the coupler resonant frequency, a shorting plunger in the secondary cavity is adjusted to effectively change the electrical length of the secondary cavity and inductive elements, extending between the inner and outer tubes, are positioned at different places along the lengths of the tubes.

Another aspect of the invention includes a vacuum tube of the aforementioned type wherein DC bias voltages for the grid and cathode are supplied by first and second leads connected to inner and outer r.f. signal coupling metal coaxial tubes at positions $n_1\lambda/4$ from the grid and cathode, while heater current is supplied via a third lead that extends through the interior tube at a position $n_1\lambda/4$ from the grid and cathode, where $n_1$ is an odd integer and $\lambda$ is the wavelength of the signal. Such an arrangement minimizes the r.f. voltage on these leads because r.f. voltage is at a minimum at $n_1\lambda/4$ from the grid and cathode.

Yet another aspect of the invention eliminates the requirement for placing the bias leads at specific frequency-dependent locations by shielding the leads with hollow conductive elements extending between the inner and outer tubes of the resonant input structure. With one or more conductive elements located at fixed positions, a wide range of tuning is achievable.

The above and still further objects, features and advantages of the present invention will become apparent upon consideration of the following detailed descriptions of several specific embodiments thereof, especially when taken in conjunction with the accompanying drawings.

BRIEF DESCRIPTION OF DRAWINGS

It is to be understood that elements designated by the same reference numerals in different figures of the drawing identify the same elements.

BEST MODE FOR CARRYING OUT THE INVENTION

Figure 1:
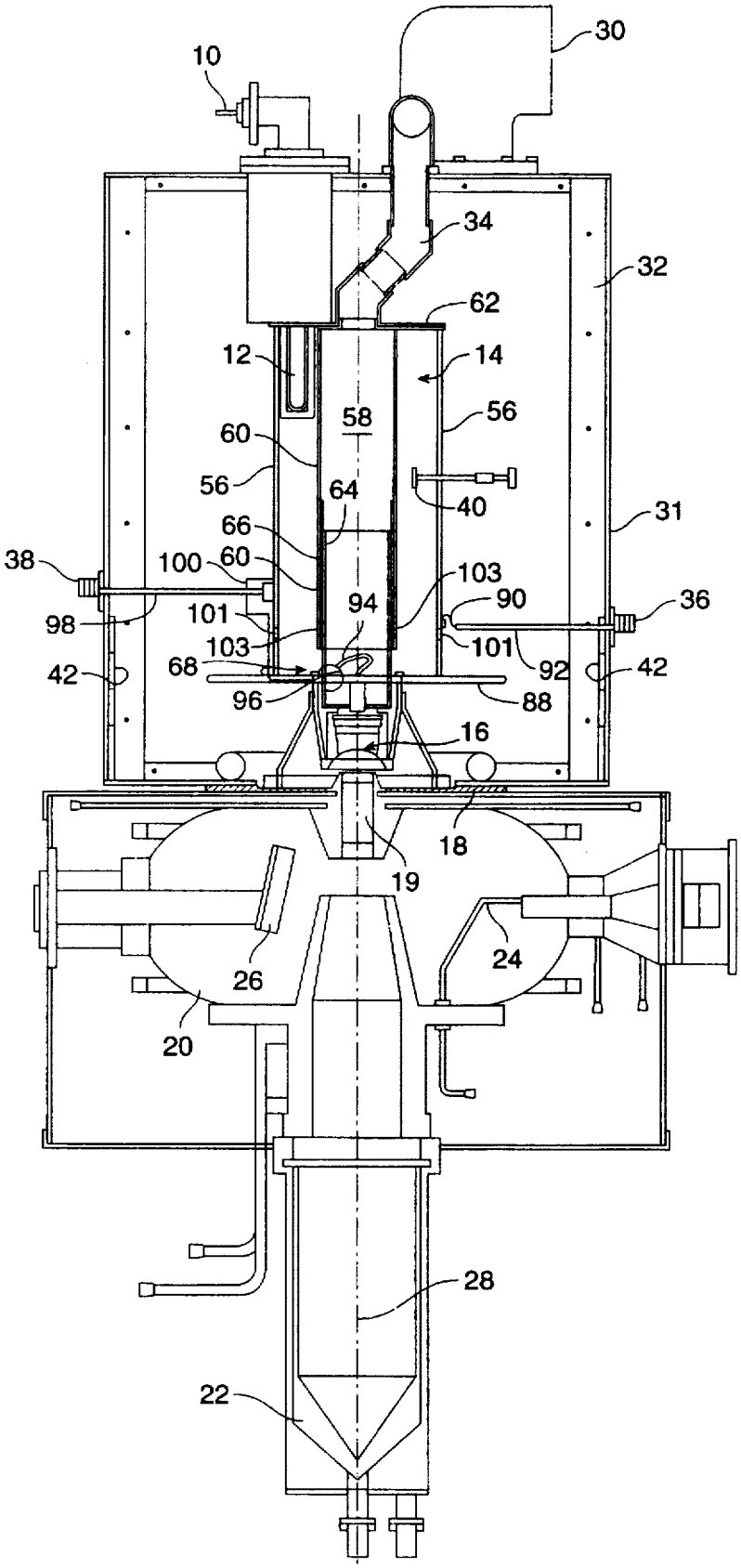
FIG. 1 is a sectional view of one embodiment of a vacuum tube incorporating the present invention.

Reference is now made to FIG. 1 of the drawing, a sectional view of a vacuum tube in accordance with one embodiment of the present invention, particularly adapted for deriving a relatively narrow bandwidth sinusoidal type wave that is applied to a particle accelerator stage. The tube of FIG. 1 includes coaxial input connection 10 which is connected to coupling loop 12, coupled to coaxial non-regenerative coupler 14, in turn connected to grid-cathode assembly 16. Electrons from the cathode of assembly 16 are density modulated by the grid of the assembly and the resulting electron bunches are accelerated by the DC field between the grid and grounded accelerating anode 18; for the particle accelerator application, the voltage between grid-cathode assembly 16 and anode 18 is on the order of 85 kV. Electrons passing through aperture 19 in anode 18 traverse output resonator 20, thence are incident on collector 22. Resonator 20 includes output loop 24 and a variable tuning capacitor including plate 26 that is movable transversely of the vacuum tube center line 28. A vacuum is provided in the volume subsisting between grid-cathode assembly 16 and collector 22, while most of coupler 14, loop 12 and connector 10 are at atmospheric pressure or slightly above.

Anode 18 and the exterior of metal housing 32 for loop 12, coupler 14 and assembly 16 are maintained at ground potential, while grid-cathode assembly 16 is maintained at approximately −85 kV. The grid of assembly 16 is maintained at a voltage of approximately −280 V relative to the cathode. DC bias for the grid of assembly 16 is applied to single "live" terminal connector 36 mounted on exterior wall 31 of housing 32, while bias voltage for the cathode of assembly 16 and energization current for the cathode heater are applied to two "live" terminal connector 38 on housing wall 31. Tuning for the vacuum tube of FIG. 1, over a relatively narrow frequency range, is provided by moving metal plate 40 transversely of center line 28 in coupler 14.

The grid of assembly 16 is fabricated of non-electron emissive material, such as pyrolytic graphite or molybdenum coated with zirconium, and spaced from the assembly cathode by a distance no greater than the distance an electron emitted from the cathode can reach the grid in a quarter cycle of the signal applied to connector 10. This type of construction is described in the aforementioned patents. The grid and cathode of assembly 16 respond to the signal coupled to them via coaxial connector 10 to current modulate the linear electron beam emitted by the cathode and accelerated by anode 18 to collector 22. The resulting electron bunches propagating from the grid of assembly 16 and through opening 19 in anode 18 interact with resonant modes of the structures surrounding the region between the grid and anode 18 to cause r.f. fields at many frequencies to be established in the interaction region.

In accordance with one important aspect of the present invention, the interiors of housing walls 31, in the vicinity of grid-cathode region 16 and anode 18, are covered. For r.f. absorbers 42 or other materials having lossy characteristics such as carbon, ECCOSORB,™C-RAM FT,™ or C-RAM ALU,™ all of which are commercially available products, may be used. example, C-RAM FT™ and C-RAM ALU™ are available from Cuming Corporation of Avon, Massachusetts. R.f. absorbers 42 basically surround the interaction region between assembly 16 and anode 18 to absorb any potential r.f. fields generated by the bunched electrons. It has been found that the r.f. absorbing capabilities of r.f. absorbers 42 are such that there is no need for assembly 16 and anode 18 to be shunted by a capacitor or coaxial or strip line open-ended resonant circuits, as was necessary in the prior art. R.f. absorbers 42 heavily load the interaction region between assembly 16 and anode 18 so a resonant impedance cannot be formed in the interaction region. Because the r.f. fields in the interaction region are absorbed by r.f. absorbers 42, they are not reflected back into the interaction region and are decoupled from assembly 16, anode 18 and output cavity 20. The power gain of the tube including assembly 16, anode 18, cavity 20 and collector 22 is thereby maintained at a relatively high level and interference with other equipment does not occur because r.f. fields produced in the interaction region are absorbed by r.f. absorbers 42.

There are certain problems in coupling the r.f. signal connected to connector 10 at basically zero DC voltage to the high negative DC voltage (for example, −85 kV) of assembly 16.

Figure 2:
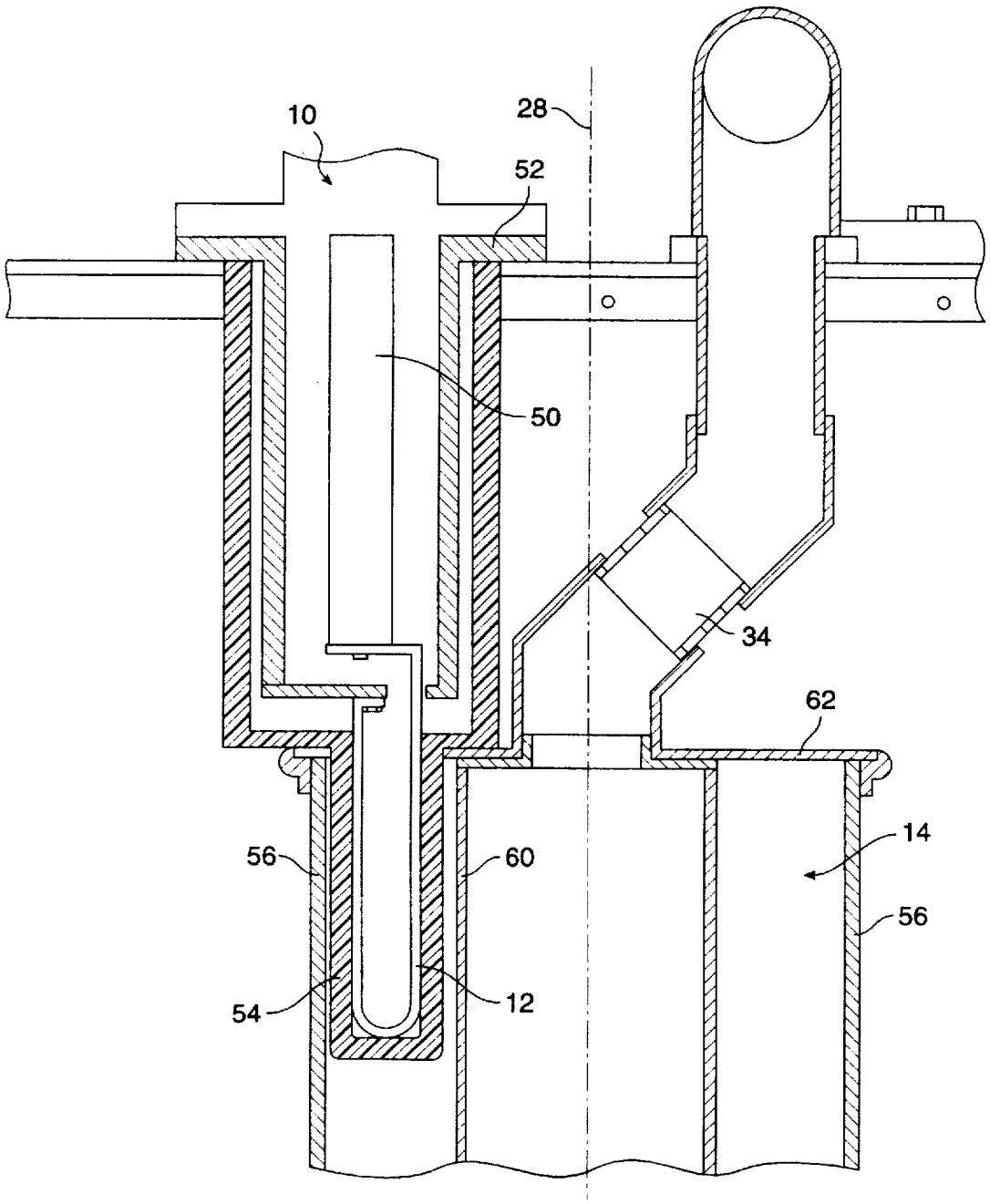
FIG. 2 is a sectional view of a portion including a loop coupler of the tube illustrated in FIG. 1.
Figure 3:
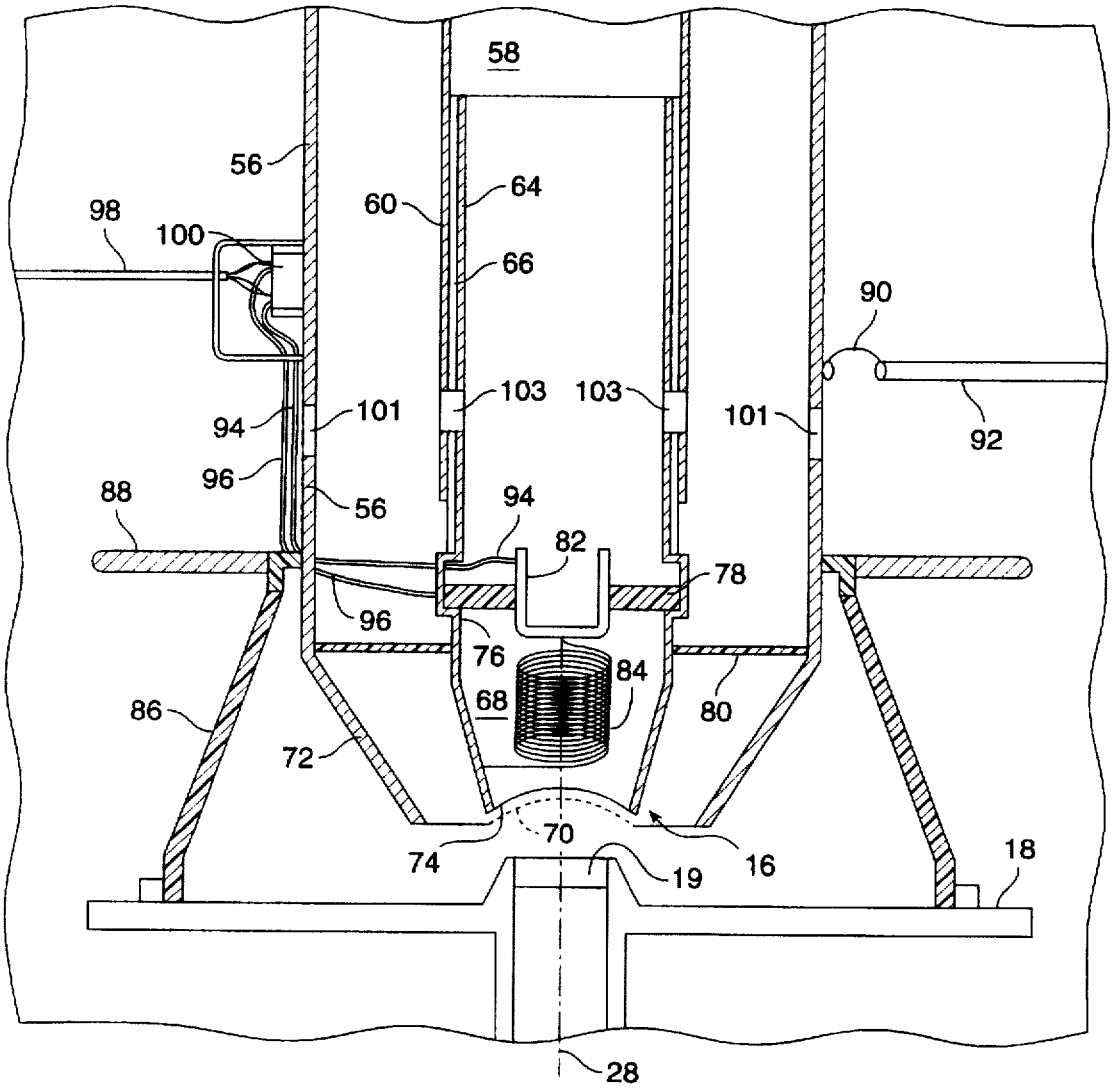
FIG. 3 is a sectional view of a portion including a grid-cathode region of the tube illustrated in FIG. 1.

This problem is resolved in the tube of FIG. 1 by a structure shown in more detail in the sectional views of FIGS. 2 and 3, wherein coaxial connector 10 is illustrated as including center metal conductor 50 and outer, grounded conductor 52. A suitable coaxial cable connects an r.f. source having a relatively fixed known frequency to one end of each of conductors 50 and 52, as clearly shown in FIG. 2. The other end of center conductor 50 is connected to one end of metal loop 12, having another end. Loop 12 is surrounded by a dielectric case 54 which may be of any suitable dielectric material such as, preferably, TEFLONTM. Dielectric case 54 also surrounds a substantial portion of outer conductor 52. Loop 12 extends parallel to center line 28 and is magnetically coupled to coupler 14, that is resonant to the frequency of the source connected to connector 10. Coupler 14 includes outer, metal tube 56 and interior tube assembly 58; tube 56 and tube assembly 58 both have a circular cross section and are concentric with and surround center line 28. Interior tube assembly 58 includes exterior metal tube 60 (FIG. 3) extending from the vicinity of loop 12 to the vicinity of assembly 16. Interior tube assembly 58 also includes relatively short metal tube 64 (FIG. 3) that is inside of and is mechanically separated from tube 60 by dielectric sleeve 66, preferably formed of KAPTON™ or a similar material. Sleeve 66 enables aligned portions of tubes 60 and 64 to be at substantially the same r.f. potential and at different DC potentials.

The end of metal tube 60 proximate loop 12 abuts metal end cap 62 (FIG. 2) including a flange for centering tube 60. Thereby, the end of tube 60 and end cap 62 are at the same r.f. voltage. End cap 62 has an opening for receiving conduit 34 so air can be pumped through tube 60. Conduit 34 is made of an electrical insulator so tube 60 and cap 62 can be biased to a high negative DC voltage relative to grounded housing 32.

Loop 12 is positioned between metal tubes 56 and 60 so the r.f. signal supplied to connector 10 is magnetically coupled as an r.f. field by loop 12 to tubes 56 and 60 (FIG. 2). Tube 56 and tube assembly 58, together with grid-cathode connector assembly 68, form a coaxial resonant transmission line having a length equal to an odd quarter multiple of a wavelength of the r.f. signal supplied to connector 10; preferably, the coaxial resonant structure between loop 12 and assembly 16 has a length of $3\lambda/4$, where $\lambda$ is the r.f. source center frequency. Thereby, the r.f. voltage of metal plate 62, at the end of coupler 14 remote from grid-cathode assembly 16, has a minimum value and there is a maximum r.f. voltage at the opposite end of the transmission line, where assembly 16 is located. Fine control for the frequency of coupler 14 is provided by moving capacitor plate 40 (FIG. 1) transversely of center line 28 between tubes 56 and 60 during initial installation of the tube.

As illustrated in FIG. 3, outer conductor 56 is connected to arcuate grid 70 of assembly 16 via metal frusto-conical cup 72. Arcuate cathode 74 of assembly 16, positioned so it is generally parallel to grid 70, is connected to tube 64 by metal sleeve 76, having an interior wall portion abutting against and bonded to dielectric plate 78 that forms a portion of a vacuum seal for the vacuum tube interior. A portion of the metal tube 76 exterior wall abuts against one edge of dielectric washer 80, forming an additional portion of the vacuum tube vacuum seal. Washer 80 has an exterior edge bonded to the interior wall of cup 72. The interior wall of plate 78 is bonded to a wall of metal cup 82, having a bottom face connected to one end of heater wire 84, having another end connected to the interior wall of metal tube 76. The vacuum tube vacuum seal also includes dielectric frusto-conical ceramic shell 86, extending between metal flange 88, in turn connected to the bottom portion of metal tube 56. The other end of shell 86 is bonded to anode 18. Heater wire 84 includes a coiled portion in proximity to cathode 74, so heat radiated from the heater wire causes electrons to be emitted from the cathode.

A high DC voltage (e.g., −85 kV) supply for assembly 16, is applied via connector 36 (FIG. 1) and electrically insulated lead 90 in cable 92 to metal tube 56 at a point a quarter wavelength away from grid-cathode assembly 16. The connection of lead 90 to tube 56 at this point substantially decouples r.f. voltage at grid 70 from the DC source connected to connector 36. The DC voltage on lead 90 is decoupled from wall 32 and DC coupled to grid 70 via tube 56 and cup 72.

Current for heater wire 84 and bias voltage for cathode 74 (about 275 volts DC greater than the voltage of grid 70) are respectively supplied via electrically insulated leads 94 and 96 of cable 98. Cable 98 extends between connector 38 (FIG. 1) and connector 100, mounted on wall 56 so the leads are DC decoupled from the wall.

Insulated leads 94 and 96 extend along the exterior of tube 56 to flange 88, thence through an opening close to the bottom of tube 56 radially toward center line 28. Leads 94 and 96 are respectively connected to cap 82 and tube 76 with lead 94 extending through an opening in tube 64 outside of the vacuum tube.

To cool the portion of the tube vacuum envelope adjacent grid-cathode assembly 16, air is pumped via scoop 30 (FIG. 1) into housing 32, having a square cross section. The air flows through apertures 101 (FIG. 3) in tube 56 close to the assembly, thence through aligned apertures 103 in tubes 60 and 64, as well as sleeve 66, and to the interior of coupler 14 to conduit 34 (FIGS. 1 and 2).

The vacuum tube illustrated in FIGS. 1–3 has been found to provide admirable results in powering a particle accelerator. The tube is easily adjusted for frequency over a narrow band (e.g. at ±2 MHz centered on 267 MHz) suitable for particle accelerator applications. The vacuum tube has adequate power gain, without high voltage DC breakdown problems, and does not require a by-pass capacitor or other circuit elements to be connected in shunt between the grid and cathode to minimize r.f. radiation in an interaction region between grid-cathode assembly 16 and anode 18.

In accordance with other embodiments of the invention, the device illustrated in FIGS. 1–3 is modified so it can be used as a power output tube of UHF television transmitters over the entire UHF television broadcast spectrum. Such a device is advantageously easily adjusted on site, to be acceptable to UHF broadcasters. Typically, UHF transmitters have a 32 kV potential difference between the anode and grid-cathode assembly, and each tube provides approximately 60 kW of r.f. output power. These characteristics are provided by the tubes of the other embodiments.

Figure 4:
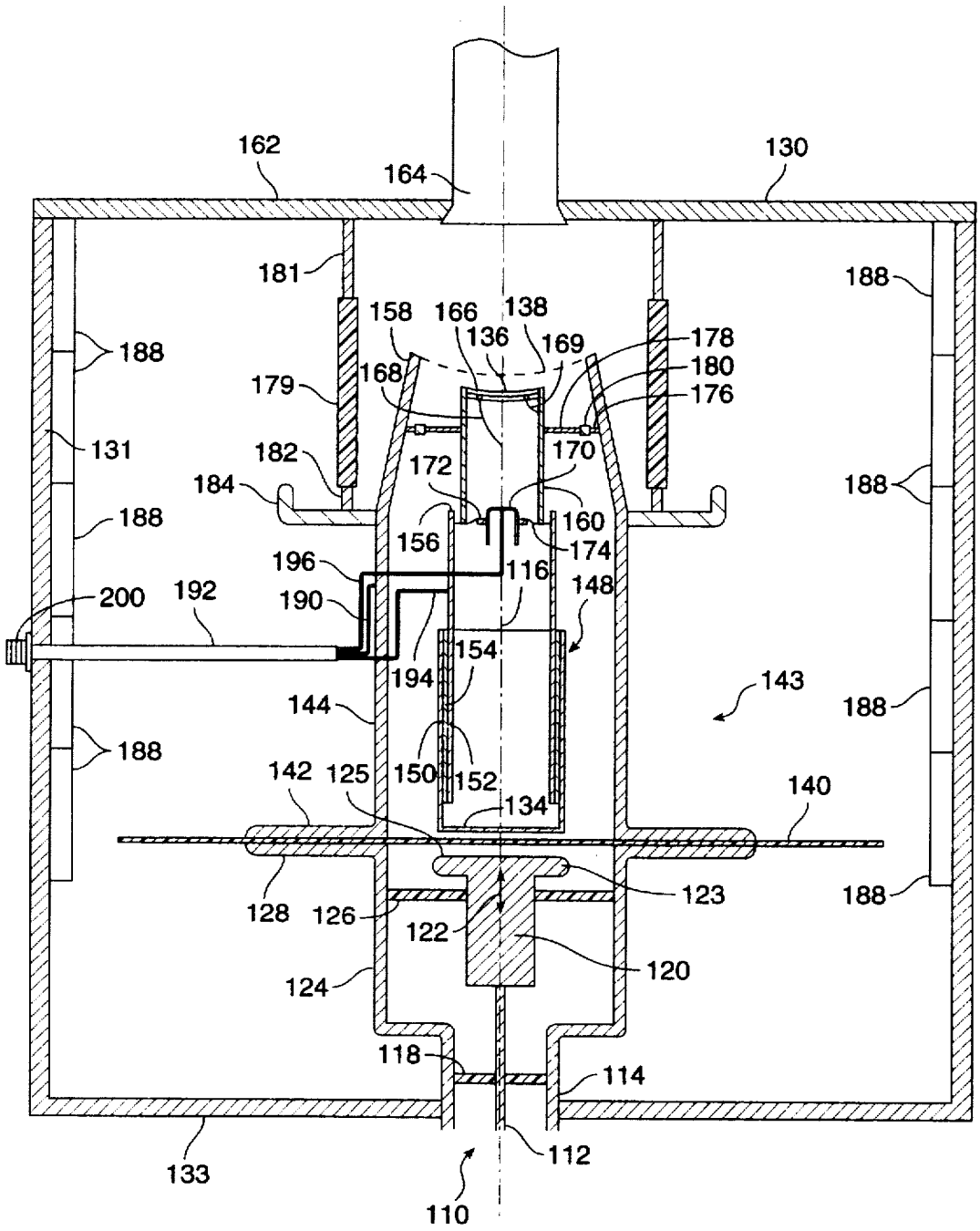
FIG. 4 is a sectional view of a portion of a second embodiment of a vacuum tube incorporating the present invention.

The basic configuration of the input portion of an electron tube in accordance with the other embodiments, particularly adapted for UHF television transmitters, is illustrated in FIG. 4. Specific structures enabling the basic structure illustrated in FIG. 4 to be tuned over to UHF spectrum are illustrated in FIGS. 5–8. To simplify the drawing, the structures illustrated in FIGS. 4–8 do not include the output cavity and collector, i.e., the circuitry downstream of the anode. The structures illustrated in FIGS. 4–8 are shorter in length and are tunable over a much broader frequency range than the device illustrated in FIG. 1–3, while providing the advantages of the tube of FIGS. 1–3.

In the vacuum electron tube of FIG. 4 an r.f. signal, e.g., a television signal, is coupled to coaxial line 110, including inner and outer metal, conductors 112 and 114 coaxial with the electron tube center line or axis 116. Inner conductor 112 is maintained in place by dielectric spacer insulator 118 and is electrically connected to one end of metal plunger 120. Plunger 120 is translatable back and forth along axis 116, as indicated by arrow 122, by a suitable drive mechanism (not shown). Plunger 120, surrounded by metal cup 124, is centered on axis 116 by dielectric washer 126, having inner and outer radii respectively contacting the plunger 120 outer wall and cup 124 inner wall. Cup 124 includes radially extending metal flange 128, having an outer periphery that is spaced from side wall 131 of metal container 130. Plunger 120 includes radially extending flange 123 and planar face 125 extending at right angles to center line 116. Face 125 and a corresponding, but opposite, face of metal plate 134 provide capacitive coupling to cathode 136 for the r.f. signal connected to coaxial line 110. Cathode 136 is closely spaced to grid 138, as described supra, for cathode 74 and grid 70.

Face 125 and plate 134 are separated from each other by dielectric plate 140, typically having a thickness of between 30 and 60 mm and a diameter so the periphery thereof extends substantially beyond the periphery of flange 128. Dielectric plate 140 may be constructed preferably from TEFLON,™ alumina, glass, mica, or other suitable dielectric material. Dielectric plate 140 is sandwiched between opposite faces of flanges 128 and 142, which extend radially from the end of metal tube 144. Plate 140 has a geometry and is constructed such that breakdown does not occur through it even though flange 128 is at DC ground while flange 142 is at a high voltage, such as −32 kV. Tube 144 forms the exterior of a resonant coaxial half-wave coupler 143 between face 125 and grid 138. A half wavelength coupler is employed in the embodiment of FIG. 4 to maximize the grid-cathode r.f. voltage of the capacitive coupling from face 125 to plate 134. The coupler of FIGS. 1–3 has a length of $3\lambda/4$ or some other odd multiple of a quarter wavelength to maximize the grid-cathode r.f. voltage of the magnetic coupling from loop 12 to tubes 56 and 60.

Coupler 143, including tube 144, also comprises interior tube assembly 148, formed by metal tube 150, integral with end plate 134 and separated from interior metal tube 152 by dielectric sleeve 154, preferably formed of KAPTON or a similar material. Tubes 144, 150 and 152 and sleeve 154 are all concentric with axis 116. Sleeve 154 provides DC isolation between tubes 150 and 152, while enabling aligned parts of these tubes to be at substantially the same r.f. potential. The end of tube 144 remote from flange 142 is DC connected by frusto-conical cup 158 to grid 138. R.f. coupling is provided from outer conductor 114 to grid 138 via the wall of cup 124, flange 128, through the gap between flanges 128 and 142 formed by dielectric plate 140, and along the lengths of tube 144 and cup 158. R.f. coupling is provided from inner conductor 112 to cathode 136 via plunger 120 and flange 123 thereon, to plate 134 via dielectric plate 140, thence to tube 150, across sleeve 154 to tube 152. The end of tube 152 extending beyond tube 150 is connected by radially biased metal leaf spring assembly 156 to metal tube 160, in turn connected to cathode 136.

Electron bunches in a linear electron beam passing through grid 138 are accelerated by grounded anode 162 to pass through opening 164 in the anode into an output cavity, and thence to a collector, as described in connection with FIG. 1. Grounded anode 162 is connected to one edge of metal side wall 131 having an opposite edge connected to metal lid 133 of container 130. To establish the beam, cathode 136 is heated by heater 166, having opposite ends respectively connected by wires 168 and 169 to metal cup 170 and metal tube 160.

Cathode 136, grid 138, heater 166 and the space between these elements to the interior face of anode 162 are in a vacuum formed by a seal between metal tube 160 and cup 170 by dielectric washer 172 and metal radial leaf spring 174. The vacuum seal is also formed by metal rings 176 and 178, between which dielectric washer 180 is wedged; rings 176 and 178 have inner and outer edges bearing against the outer and inner peripheries of tube 160 and shell 158. The vacuum seal is completed by longitudinally extending dielectric tube 179, having opposite ends connected to metal tubes 181 and 182, in turn connected to anode 162 and metal flange 184 at the end of shell 158 remote from grid 138.

To obviate the need for a circuit element to shunt grid 138 and anode 162 and improve efficiency, side walls 131 of container 130 are preferably lined with r.f. absorbers 188, which perform the same function and may be made of the same material as r.f. absorbers 42 in the embodiment of FIG. 1.

Grid 138 is maintained at −32 kV relative to grounded anode 162 by connecting one end of electrically insulated lead 190 of cable 192 to the exterior wall of tube 144, at a position removed from grid 138 by approximately one-quarter of a wavelength of the r.f. signal coupled to line 110. Cable 192 also includes leads 194 and 196 that are insulated from each other and lead 190. Leads 194 and 196 respectively supply bias voltage to cathode 136 and energizing current to heater 166. Leads 194 and 196 extend through an aperture (not shown) in tube 144, with the ends of leads 194 and 196 respectively connected to tube 152 and cup 170. Lead 174 is connected to tube 152 and lead 196 extends through a hole in tube 152 at positions removed from cathode 136 by about one-quarter of a wavelength of the r.f. signal coupled to line 118. The bias voltage on lead 194 is supplied by tube 152 to cathode 136 by way of metal spring finger 156 and tube 160. The current flowing in lead 196 is coupled to heater 166 via cup 170 and lead 168 and from the heater 166 to tube 160 via lead 169. Cable 192 and the leads therein extent through an aperture in side wall 131 of housing 130 to terminal block 200, mounted on the exterior of the housing wall.

The r.f. voltages on leads 190 and 194 are minimized because these leads are respectively connected to tubes 144 and 150 at positions a quarter wavelength from the grid-cathode assembly. The r.f. voltage on lead 196 is minimized because this lead goes through a hole in tube 152 at a position a quarter wavelength from the grid-cathode assembly and is r.f. shielded inside tube 152.

The grid-cathode region of the vacuum tube illustrated in FIG. 4 is cooled in a manner similar to that illustrated in FIG. 1. To this end, a conduit (not shown) extends through suitable, aligned apertures in tubes 144 and 152, to the interior of tube 152 and openings are provided in tube 152 in the vicinity of springs 156 and 174. The conduit extending through tubes 144 and 152 in the vicinity of plate 134 extends through an aperture in housing 130, to a pump outside of the housing. Air flowing out of the apertures in tube 152 in the vicinity of springs 156 and 174 leaks to the atmosphere through openings in tube 144 and through housing 130.

The structure illustrated in FIG. 4 has certain advantages over that illustrated in FIGS. 1–3. The FIG. 4 structure is smaller, since the coaxial coupler is basically a one-half wavelength transmission line, while the coupler illustrated in FIGS. 1–3 is a three-quarters wavelength line. In addition, relatively expensive and cumbersome loop coupler 12 of FIGS. 1–3 is replaced by the smaller and less expensive capacitive coupling through the dielectric of plate 140.

Structure generally illustrated in FIG. 4 is particularly adapted to be set to any frequency in the UHF television band, for television broadcast purposes. Structures illustrated schematically in FIGS. 5–8 can be used to set the operating frequency of the resonant coupler between line 110 and cathode 136 and grid 138. In each of the embodiments of FIGS. 5–7, plunger 120 and face 125 thereof are translatable relative to metal plate 134 along axis 116 by suitable means of a type known to those of ordinary skill in the art. Movement of face 125 relative to plate 134 adjusts the impedance between line 110 and the half-wavelength coupler including tubes 150, 152 and 144 to provide a proper impedance match. DC energizing voltages for the grid-cathode assemblies and heaters of the tubes illustrated in FIGS. 5–8 are established by the structure illustrated in FIG. 4, whereby the interior conductors are illustrated in these figures without inner and outer tubes 150 and 152 or dielectric sleeve 154.

Figure 5:
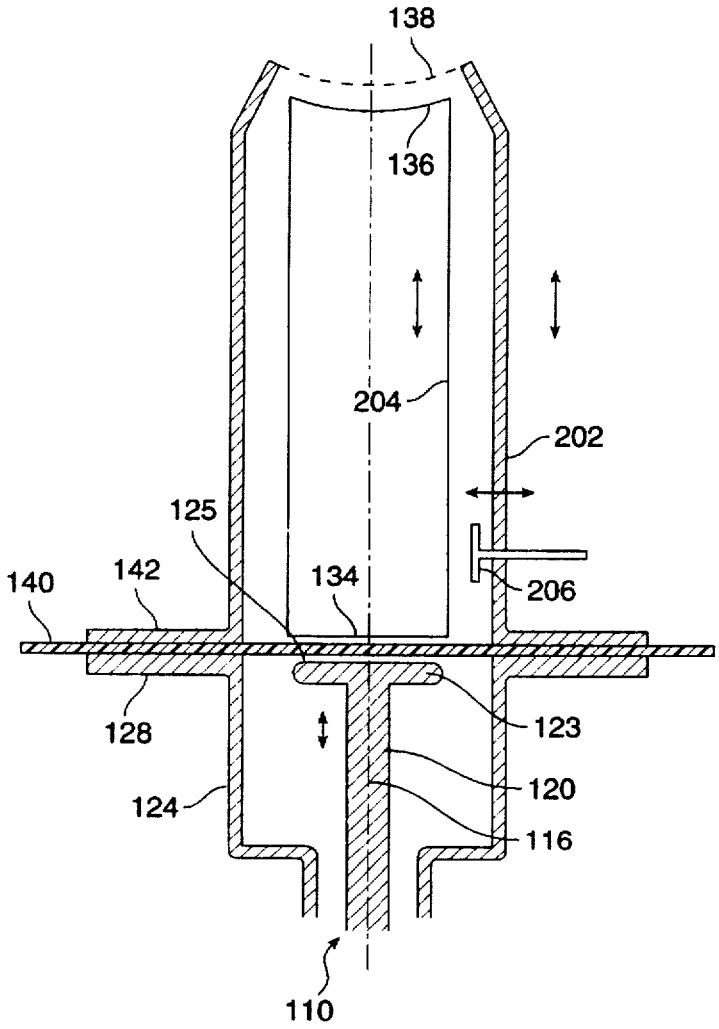
FIG. 5 is a schematic view of a structure of the type illustrated in FIG. 4 wherein the resonant frequency of a half-wavelength input coupler is varied by effectively changing the coupler length.

In the structure illustrated schematically in FIG. 5, the resonant frequency of the half-wavelength coupler between face 125 and cathode 136 and grid 138 is changed by varying the effective lengths of the metal tubes between dielectric plate 140 and the grid and cathode. To these ends, fixed length tubes 144 and 152 of FIG. 4 are respectively replaced in FIG. 5 by telescoping metal tubes 202 and 204. Tube 204 has three nested, telescoping sections (not shown) that are slidable relative to each other in the direction of axis 116, while exterior tube 202 includes two nested slidable sections (not shown). The sections of telescoping tubes 202 and 204 are coupled to each other by suitable mechanical means (not shown) so that as the length of one tube is changed, the length of the other tube varies accordingly. Adjustment of the effective lengths of tubes 202 and 204 sets the resonant frequency of the coupler between plate 140 and cathode 136 and grid 138 to the approximate resonant frequency of the signal being handled by the tube. More precise, fine tuning is provided by moving metal plate 206 transversely of center line 116 between metal tubes 202 and 204.

The structure of FIG. 5 is considerably easier to adjust than the prior art regenerative coupler. However, it is costly to provide the telescoping structures and the mechanisms for moving them.

Figure 6:
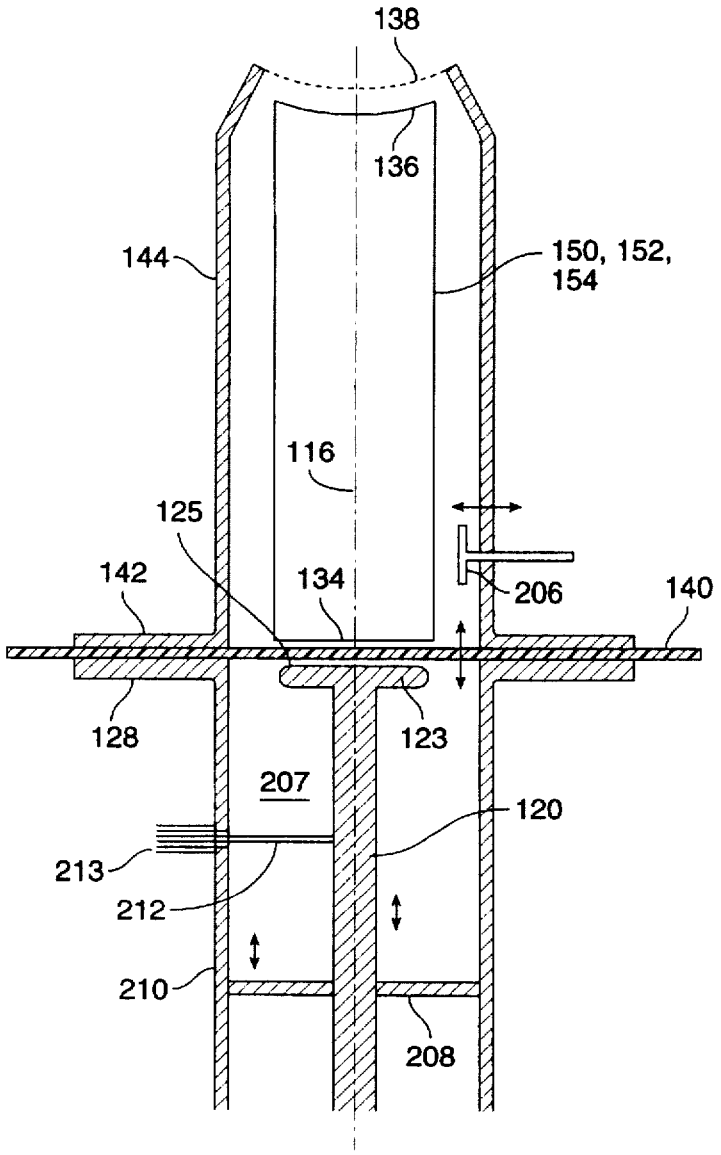
FIG. 6 is a schematic view of a structure of the type illustrated in FIG. 4 wherein the resonant frequency of an input coupler is effectively varied by changing the length of a quarter-wavelength secondary coupler.

To overcome some of these problems with the device illustrated in FIG. 5, the structure of FIG. 6 was developed. In FIG. 6, flange 123 and the remaining elements "below" plate 140 are in secondary, quarter-wavelength resonant coupler 207 and the fixed length, fixed position tubes 144,150 and 152 of FIG. 4 are employed to form a half wavelength primary resonant coupler. In addition, movable metal plate 206 is retained, as is the translatable feature of face 125 on plate 123 of plunger 120. In the tube of FIG. 6, coupler 207 includes the coaxial cylindrical metal wall of plunger 120 and outer metal tube 210. Metal, shorting disc 208 extends between the wall of metal plunger 120 and the wall of metal tube 210. The r.f. signal to be amplified is coupled to the secondary cavity by a coaxial cable having a center conductor 212 connected to the cylinder of plunger 120 and an outer conductor 213 connected to the wall of tube 210. Shorting disc 208 is set at different positions along the lengths of the cylinder of plunger 120 and tube 210 by any suitable means (not shown) to control the resonant frequency of secondary coupler 207.

The position of shorting disc 208 is predetermined for each of the possible operating frequencies of a UHF television transmitter. After disc 208 has been set in position, face 125 is translated relative to dielectric plate 140. The position of metal plate 206 is then adjusted. Iterations in the positions of face 125, plate 206 and possibly shorting disc 208 are made until the desired operating parameters are attained. While the structure of FIG. 6 is mechanically simpler than the telescoping tube structure of FIG. 5 and adjustment of the tube to achieve proper operating characteristics is somewhat simpler than the structure of FIG. 5, the structure of FIG. 6 is considerably larger than that of FIG. 5 because of the inclusion of coupler 207.

Figure 7:
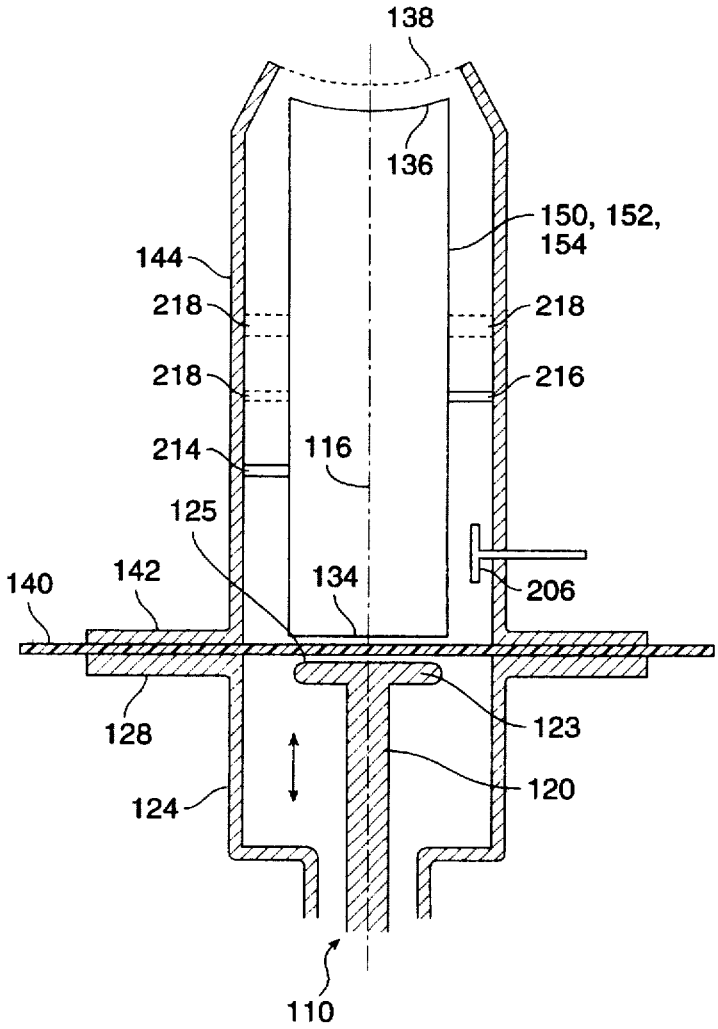
FIG. 7 is a schematic view of a structure of the type illustrated in FIG. 4 wherein the input coupler resonant frequency is varied by inductively loading a half-wavelength coupler.

A structure which is mechanically simpler and easier to adjust the resonant frequency of the half wavelength coupler than the structures of FIGS. 5 and 6 and is about the same size as the FIG. 5 structure is illustrated in FIG. 7. In FIG. 7, secondary resonant coupler 207 is not used; instead, the same half wave resonant structure for coupling the signal to the region between face 125 and plate 134 that is illustrated in FIG. 4 is employed in FIG. 7. In addition, fine tuning is provided by metal plate 206, in the same manner as described in connection with FIGS. 5 and 6.

Approximate tuning of the half wavelength input resonant coupler for the carrier frequency of each of the UHF television channels is attained by selectively inserting one or more inductive, metal (preferably brass) tuning plugs, e.g. plugs 214 and 216, at discrete positions between fixedly mounted and fixed length inner and outer tubes 144, 150 and 152. To these ends, tubes 144, 152 and 154 include aligned apertures (having positions shown by dotted lines 218) into which the inductive metal plugs are selectively inserted. The plugs are spring biased by a conventional structure (not shown), against the walls of tubes 144, 150 and 152 and dimensioned so they form inductive shunts between exterior tube 144 and one of the interior tubes 150 or 152; typically, the plugs are formed as cylinders having a diameter such as 0.090".

A different carrier frequency for each UHF television broadcast carrier is associated with different combinations of the positions of the apertures along center line 116. Prior to delivery of a particular vacuum tube to a particular UHF television transmitter, one or more of the plugs are appropriately inserted and secured in the appropriate apertures. Upon delivery and connection of the tube to its load, it is merely necessary to adjust the position of face 125 relative to dielectric plate 140, to provide impedance matching to the transmitter load and to adjust the position of plate 206 for fine tuning.

Figure 8:
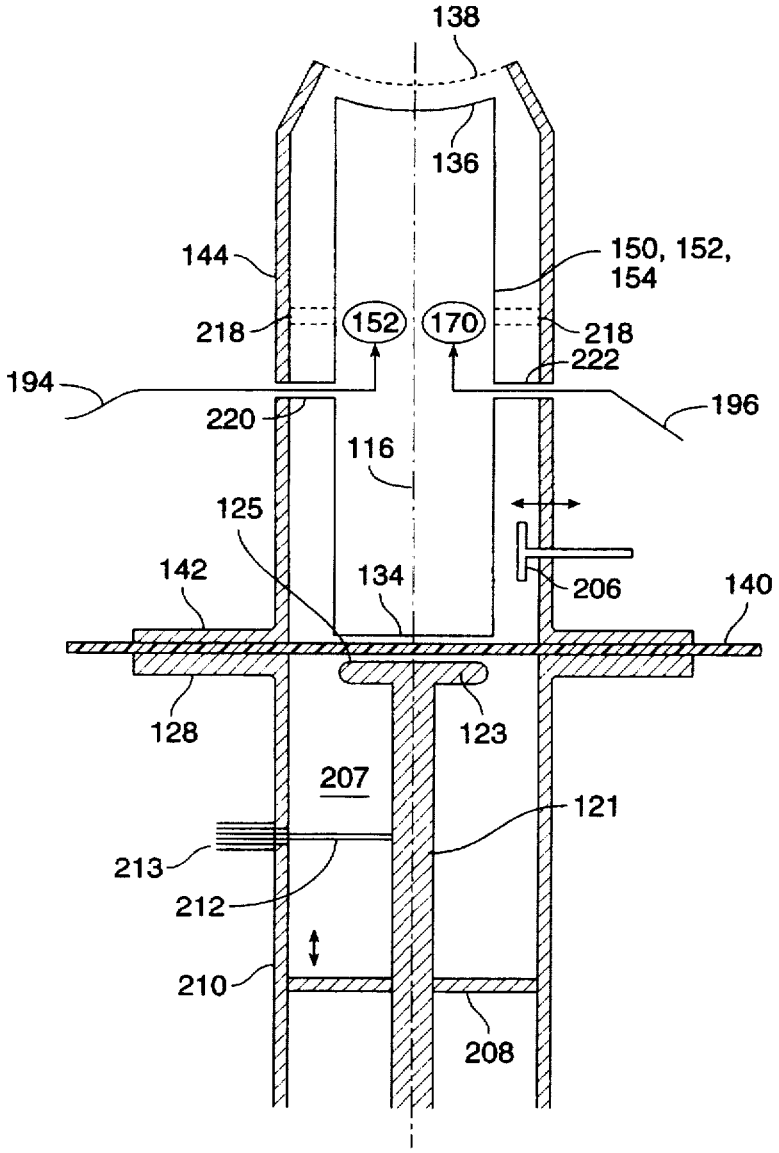
FIG. 8 is a schematic view of a structure of the type illustrated in FIG. 4 wherein the coupler resonant frequency is varied by changing the length of a secondary coupler and by loading a primary resonant coupler with inductive elements at fixed locations, and further wherein the bias leads required for tube operation are shielded by the inductive elements.

While the structure of FIG. 7 is compact, the coupling and Q of the resonant input structure is adversely affected by adjustments made to the position of face 125 when attempting to achieve a proper impedance match between coaxial line 110 (refer to FIG. 4) and the half-wavelength coupler including tubes 150, 152 and 144. The structure shown in FIG. 8 provides a solution for the drawbacks in the structure of FIG. 7 by incorporating the secondary resonant coupler 207 of FIG. 6 and the inductive tuning plugs (e.g., 214 and 216) of FIG. 7. The structure of FIG. 8 does not rely on movement of face 125 to achieve proper impedance matching, and, therefore, is able to maintain desirable coupling and system gain across a wide range of operating frequencies. The movable plunger 120 of FIGS. 4–7 is replaced in the structure of FIG. 8 by metal plunger 121 which is fixed and not translatable back and forth along axis 116. Tuning may be achieved by: (1) adjustment of metal, shorting disk 208 in the secondary resonant coupler 207 similar to that shown in the tube of FIG. 6, (2) adjustment of movable metal plate 206 in the same manner as described in connection with FIGS. 5–7, and (3) by selectively inserting inductive tuning plugs (e.g., plugs 214 and 216) at discrete positions between fixedly mounted and fixed length tubes 144, 150 and 152 of the primary resonant coupler in the same manner as described in connection with FIG. 7. Note that the inductive tuning plugs (e.g., plugs 214 and 21.6) are not shown in the structure of FIG. 8 in order to further simplify the illustration. Simple tuning across a wide frequency range may be achieved with tuning plugs installed at other predetermined and fixed locations between the inner and outer tubes 144, 150 and 152 of the primary resonant coupler.

In FIG. 8, quarter-wavelength secondary resonant coupler 207 includes the coaxial cylindrical metal wall of fixed metal plunger 121 and outer metal tube 210. Metal, shorting disc 208 extends between the wall of fixed metal plunger 121 and the wall of metal tube 210. The r.f. signal to be amplified is coupled to the secondary cavity by a coaxial cable having the center conductor 212 connected to the cylinder of fixed metal plunger 121 and the outer conductor 213 connected to the wall of tube 210.

Another important aspect of the present invention involves shielding the electrically insulated bias leads 194 and 196 from r.f. fields in the resonant input structure with hollow tuning pins. The inductive tuning plugs (e.g., 214 and 216) of FIG. 7 may be replaced in the structure of FIG. 8 with cylindrical hollow inductive tuning pins (e.g, 220 and 222). The hollow inductive tuning pins are preferably brass but may also be constructed from other conductor material and have hollow portions extending therethrough so that bias leads 194 and 196 may be inserted into the hollow portions. Similar to the tuning plugs shown in FIG. 7, the hollow inductive tuning pins (e.g., 220 and 222) are spring biased by a conventional structure (not shown) against the walls of tubes 144, 150 and 152 and dimensioned so they form inductive shunts between exterior tube 144 and one of the interior tubes 150 or 152. In FIG. 8, electrically insulated cathode lead 194 is shown as passing through hollow inductive tuning pin 220 and is connected to tube 152. Electrically insulated heater lead 196 is shown as passing through hollow inductive tuning pin 222 and is connected to cup 170. Other hollow inductive tuning pins may also be inserted in the resonant input structure for shielding other bias leads used for tube operation, including the bias lead for a relocated getter-ion pump (not shown) used in the present invention.

The bias leads 194 and 196 of the tube in FIG. 7 (not shown) may be also be shielded if tuning plugs 214 and 216 are replaced with hollow inductive tuning pins similar to 220 and 222.

For the tubes shown in FIGS. 7 and 8, if hollow inductive tuning pins 220 and 222 are being used to shield bias leads 194 and 196 and to tune the coupler resonant frequency, additional inductive tuning plugs or hollow inductive tuning pins may also be selectively inserted into aligned apertures 218 to attain more approximate tuning of the primary resonant coupler.

By using the hollow inductive tuning plugs to shield the bias leads, tuning over a wide frequency range, while maintaining a relatively simple resonant structure, is achieved by the present invention. As mentioned above, the bias leads act as receiving antennas and couple r.f. energy from the resonant input structure. The r.f. voltage on bias leads 194 and 196 are minimized if these leads are respectively connected to tubes 144 and 150 and through tubes 144 and 152 at positions $n_1\lambda/4$ from the grid and cathode assembly, where $n_1$ is an odd integer and $\lambda$ is the wavelength of the signal. The disadvantage of requiring the bias leads to pass through positions dependent on $n_1\lambda/4$ is that to achieve tuning over a wide frequency range (e.g., the commercial U.H.F. television spectrum), the bias leads will have to be positioned through the inner and outer metal tubes in numerous frequency-dependent positions that depend on the frequency of the input signal. By requiring the bias leads to pass through the frequency-dependent positions, an object of the present invention of providing a relatively simple resonant structure would be difficult to achieve. However, by passing bias leads 194 and 196 through the hollow inductive tuning pins (e.g., 220 and 222) located at fixed positions between the inner and outer tubes of the resonant input circuit (see FIG. 8), the previous requirement of having to pass the bias leads through frequency-dependent positions is eliminated. The hollow inductive metal pins can completely shield the bias leads from the r.f. fields in the resonant input structure, regardless of the frequency of the input signal.

Figure 9:
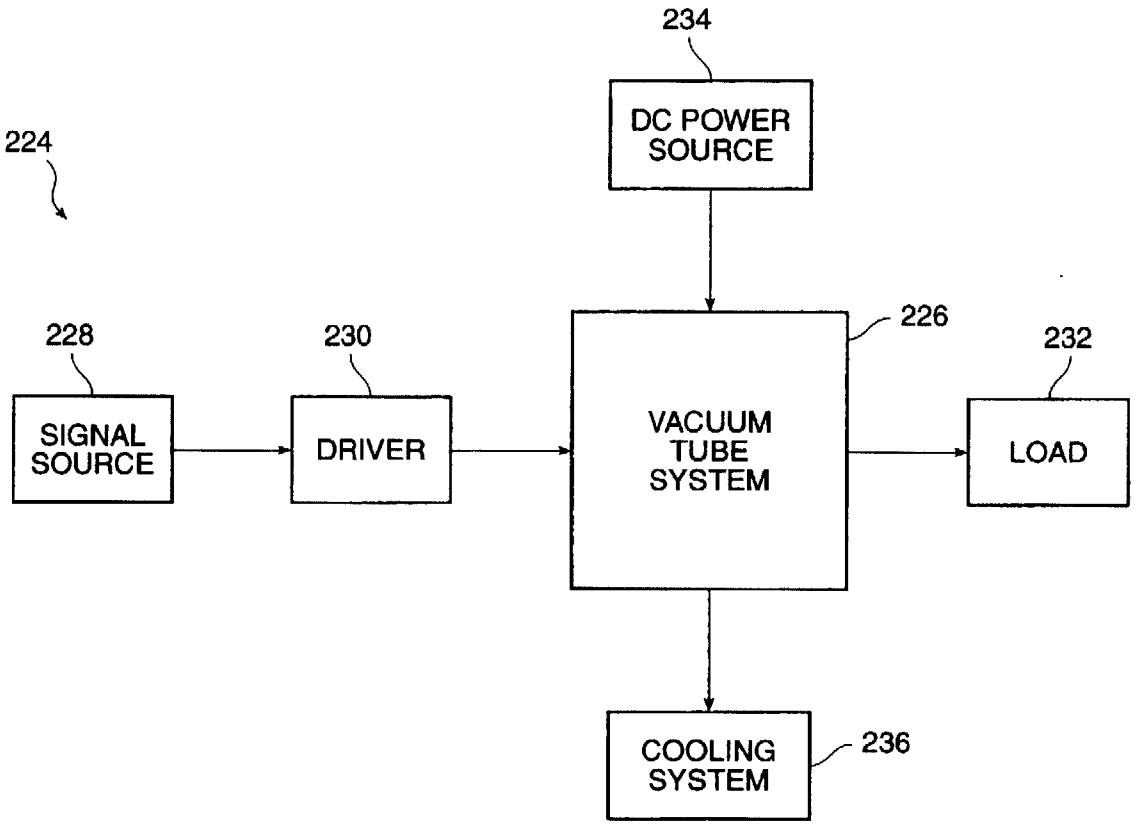
FIG. 9 is a block diagram wherein the present invention is incorporated in a transmission system.

The present invention is intended to be incorporated in the transmission system in the block diagram of FIG. 9. Transmission system 224 includes vacuum tube system 226, which incorporates the present invention and may be used to amplify r.f. signals from about 470 MHz to about 860 MHz. One example of vacuum tube system 226 is the K2 System, which will be available from the EIMAC Division of Communications & Power Industries of San Carlos, Cali. Vacuum tube system 226 is particularly suited for amplification of U.H.F. television signals, including combined sound and vision NTSC, PAL, and SECAM signals. Vacuum tube system 226 may also be used for amplification of the digital and HDTV television signals now being proposed for future standardization. The source of the r.f. signal for transmission system 224 is signal source 228, which may be any suitable signal generator or modulator. In most cases, a separate stage of amplification (shown as driver 230) is also connected between the output of signal source 228 and a first input of vacuum tube system 226. The output of vacuum tube system 226 is connected to any suitable load element 232 (such as an antenna). DC power source 234 is connected to a second input of vacuum tube system 226, while cooling system 236 is connected to a third input of vacuum tube system 226. Cooling system 236 provides air or water cooling to system 226 to remove waste heat.

While there have been described and illustrated specific embodiments of the invention, it will be clear that variations in the details of the embodiments specifically illustrated and described may be made without departing from the true spirit and scope of the invention as defined in the appended claims.

What is claimed is:

1. A vacuum tube for handling an r.f. signal having a predetermined frequency range comprising:

a cathode for emitting a linear electron beam:

a grid comprised of non-electron emissive material for current modulating the beam, the grid being positioned from the cathode no farther than a distance in which electrons emitted from the cathode can travel in a quarter cycle of the r.f. signal;

an anode for accelerating the beam;

an electrode for collecting the beam;

an output cavity resonant to a frequency of the r.f. signal positioned between the grid and electrode for collecting the beam;

a coupler responsive to the r.f. signal connected to the grid and cathode so electrons from the cathode upon passing through the grid and accelerated toward the anode are in bundles in an interaction region between the anode and grid to cause r.f. fields that are responsive to the r.f. signal to be derived in the interaction region;

r.f. absorbing material coupled to the interaction region for absorbing the r.f. fields that are responsive to the r.f. signal so there is non-regenerative coupling of the r.f. signal to the region;

wherein the coupler is resonant to a frequency of a source of the signal, and further including means for changing the resonant frequency of the coupler;

wherein the coupler includes a pair of fixed length, fixedly positioned concentric metal tubes electrically insulated from each other for DC current flow, and the changing means includes a metal, inductive structure extending between the tubes and at different axial locations along the tubes; and wherein the inductive structure comprises a cylinder of conductive material having a hollow portion therethrough.

2. The vacuum tube of claim 1 wherein the changing means further includes a metal plate movable transversely between the tubes.

3. The vacuum tube of claim 1 further including a secondary cavity electrically coupled to the coupler, the changing means further including a shorting plunger in the secondary cavity having an electrical length, the plunger being translatable relative to the secondary cavity to effectively change the electrical length of the secondary cavity.

4. The vacuum tube of claim 1 further comprising:

a signal source for generating the r.f. signal, said signal source having an output;

a driver for amplifying the r.f. signal, said driver having an input connected to said output of said signal source, and a driver output;

a vacuum tube system adapted to receive the vacuum tube and having a first input connected to said driver output for receiving the r.f. signal, a power input, a coolant input, and a load output;

a load element having an input connected to said load output;

a DC power source having an output connected to said power input; and a cooling system having an output connected to said coolant input to provide cooling to the vacuum tube system.

5. A vacuum tube for handling an r.f. signal having a predetermined frequency range comprising:

cathode for emitting an electron beam, a heater for the cathode positioned in close proximity to the cathode;

a grid comprised of non-electron emissive material for current modulating the beam, the grid being positioned from the cathode no farther than a distance in which electrons emitted from the cathode can travel in a quarter cycle of the r.f. signal;

an anode for accelerating the beam, an electrode for collecting the beam, an output cavity, resonant to a frequency of the r.f. signal, positioned between the grid and electrode for collecting the beam;

a non-regenerative coupler for the r.f. signal connected to the grid and cathode so electrons from the cathode upon passing through the grid and accelerated toward the anode are in bundles in an interaction region between the anode and the closely spaced grid and cathode, the coupler including: inner and outer coaxial metal tubes which collectively comprise a resonant line having a length of at least ½, where 1 is the wavelength of the r.f. signal, the outer and inner tubes being electrically connected to the grid and cathode, respectively, the grid and outer coaxial tube being DC isolated from the cathode and inner coaxial tube, enabling different DC voltages to be applied to the grid and cathode; and first, second and third leads for respectively biasing the grid and cathode and for supplying current to the heater, the first and second leads being respectively connected to the outer and inner metal tubes and the third lead extending through the inner metal tube, a plurality of inductive structures extending between the inner and outer metal tubes and at different axial locations along the inner and outer metal tubes, the inductive structures each having a hollow portion extending therethrough so that the second and third leads are within the hollow portion and are shielded from r.f. fields generated within the coupler.

6. The vacuum tube of claim 5 wherein the inductive structures comprise a cylinder of conductive material.

7. The vacuum tube of claim 5 wherein the inductive structures are dimensioned so as to form inductive shunts at different axial locations between the inner and outer metal tubes for tuning the coupler to a resonant frequency.

8. The vacuum tube of claim 5, further comprising;

a signal source for generating the r.f. signal, said signal source having an output;

a driver for amplifying the r.f. signal, said driver having an input connected to said output of said signal source, and a driver output;

a vacuum tube system adapted to receive the vacuum tube and having a first input connected to said driver output for receiving the r.f. signal, a power input, a coolant input, and a load output;

a load element having an input connected to said load output;

a DC power source having an output connected to said power input; and a cooling system having an output connected to said coolant input to provide cooling to the vacuum tube system.

9. A vacuum tube for handling an r.f. signal having a predetermined frequency range comprising:

a cathode for emitting a linear electron beam, a grid comprised of non-electron emissive material for current modulating the beam, the grid being positioned from the cathode no farther than a distance in which electrons emitted from the cathode can travel in a quarter cycle of the r.f. signal;

an anode for accelerating the beam;

an electrode for collecting the beam;

an output cavity resonant to a frequency of the r.f. signal positioned between the grid and electrode for collecting the beam, a coupler responsive to the r.f. signal connected to the grid and cathode so electrons from the cathode upon passing through the grid and accelerated toward the anode are in bundles in an interaction region between the anode and grid to cause r.f. fields that are responsive to the r.f. signal to be derived in the interaction region;

r.f. absorbing material coupled to the interaction region for absorbing the r.f. fields that are responsive to the r.f. signal so there is non-regenerative coupling of the r.f. signal to the region;

a signal source for generating the r.f. signal, said signal source having an output;

a driver for amplifying the r.f. signal, said driver having an input connected to said output of said signal source, and a driver output;

a vacuum tube system adapted to receive the vacuum tube and having a first input connected to said driver output for receiving the r.f. signal, a power input, a coolant input, and a load output;

a load element having an input connected to said load output;

a DC power source having an output connected to said power input; and a cooling system having an output connected to said coolant input to provide cooling to the vacuum tube system.

10. A vacuum tube for handling an r.f. signal having a predetermined frequency range comprising:

a cathode for emitting a linear electron beam;

a grid comprised of non-electron emissive material for current modulating the beam, the grid being positioned from the cathode no farther than a distance in which electrons emitted from the cathode can travel in a quarter cycle of the r.f. signal;

an anode for accelerating the beam;

an electrode for collecting the beam positioned downstream of the anode;

an output cavity, resonant to a frequency of the r.f. signal, positioned between the grid and electrode for collecting the beam;

a non-regenerative resonant coupler for the r.f. signal connected to the grid and cathode so electrons from the cathode upon passing through the grid and accelerated toward the anode are in bundles in an interaction region between the anode and the closely spaced grid and cathode, the coupler including: inner and outer coaxial metal tubes which collectively comprise a resonant line, the outer and inner metal tubes being respectively electrically connected to the grid and cathode, the grid and outer coaxial tube being DC isolated from the cathode and inner coaxial tube enabling different DC voltages to be applied to the grid and cathode, a loop disposed in a space between the outer and inner tubes at an end of the outer and inner tubes remote from the grid and cathode, the resonant coupler having a length of about $n\lambda/4$ between the grid and loop, where $\lambda$ is the wavelength of a frequency of the r.f. signal in the predetermined frequency range, and n is an odd integer;

a signal source for generating the r.f. signal, said signal source having an outputs;

a driver for amplifying the r.f. signal, said driver having an input connected to said output of said signal source, and a driver output;

a vacuum tube system adapted to receive the vacuum tube and having a first input connected to said driver output for receiving the r.f. signal, a power input, a coolant input, and a load output;

a load element having an input connected to said load output;

a DC power source having an output connected to said power input; and a cooling system having an output connected to said coolant input to provide cooling to the vacuum tube system.

11. A vacuum tube for handling an r.f. signal having a predetermined frequency range comprising:

a cathode for emitting an electron beam;

a grid comprised of non-electron emissive material for current modulating the beam, the grid being positioned from the cathode no farther than a distance in which electrons emitted from the cathode can travel in a quarter cycle of the r.f. signal;

an anode for accelerating the beam;

an electrode for collecting the beam, an output cavity, resonant to a frequency of the r.f. signal, positioned between the grid and electrode for collecting the beam;

a non-regenerative coupler for the r.f. signal connected to the grid and cathode so electrons from the cathode upon passing through the grid and accelerated toward the anode are in bundles in an interaction region between the anode and the closely spaced grid and cathode, the coupler including: a low voltage coaxial line having inner and outer conductors connected to a source of the r.f. signal, the inner conductor being connected to a first metal face, the first metal face being spaced from a second opposed metal face by a solid dielectric, the outer conductor being connected to a third metal face, the third face being spaced from a fourth opposed metal face by the solid dielectric, the third and fourth faces respectively being on structures surrounding the first and second faces, each of the metal faces having a respective periphery, the dielectric extending beyond the respective periphery of the metal faces so a substantial DC voltage can be established between the corresponding faces; the first and third faces being connected to a DC ground terminal, the second and fourth faces being connected to high negative DC voltage terminals, the second and fourth faces being respectively at common ends of inner and outer coaxial metal tubes thereby defining a half-wavelength coaxial coupler, the other ends of the inner and outer tubes being respectively connected to the cathode and grid;

a signal source for generating the r.f. signal, said signal source having an outputs;

a driver for amplifying the r.f. signal, said driver having an input connected to said output of said signal source, and a driver output;

a vacuum tube system adapted to receive the vacuum tube and having a first input connected to said driver output for receiving the r.f. signal, a power input, a coolant input, and a load output;

a load element having an input connected to said load output;

a DC power source having an output connected to said power input; and a cooling system having an output connected to said coolant input to provide cooling to the vacuum tube system.

12. A vacuum tube for handling an r.f. signal having a predetermined frequency range comprising:

a cathode for emitting an electron beam;

a heater for the cathode positioned in close proximity to the cathode;

a grid comprised of non-electron emissive material for current modulating the beam, the grid being positioned from the cathode no farther than a distance in which electrons emitted from the cathode can travel in a quarter cycle of the r.f. signal;

an anode for accelerating the beam;

an electrode for collecting the beam;

an output cavity, resonant to a frequency of the r.f. signal, positioned between the grid and electrode for collecting the beam;

a non-regenerative coupler for the r.f. signal connected to the grid and cathode so electrons from the cathode upon passing through the grid and accelerated toward the anode are in bundles in an interaction region between the anode and the closely spaced grid and cathode, the coupler including: inner and outer coaxial metal tubes which collectively comprise a resonant line having a length of at least ½, where $\lambda$ is the wavelength of the r.f. signal, the outer and inner tubes being electrically connected to the grid and cathode, respectively, the grid and outer coaxial tube being DC isolated from the cathode and inner coaxial tube, thereby enabling different DC voltages to be applied to the grid and cathode, first, second and third leads for respectively biasing the grid and cathode and for supplying current to the heater the first and second leads being respectively connected to the outer and inner metal tubes at positions approximately $n_1\lambda/4$ from the grid and cathode and the third lead extending through the inner tube at a position approximately $n_1\lambda/4$ from the grid and cathode, where $n_1$ is an odd integer;

a signal source for generating the r.f. signal, said signal source having an output;

a driver for amplifying the r.f. signal, said driver having an input connected to said output of said signal source, and a driver output;

a vacuum tube system adapted to receive the vacuum tube and having a first input connected to said driver output for receiving the r.f. signal, a power input, a coolant input, and a load output;

a load element having an input connected to said load output;

a DC power source having an output connected to said power input; and a cooling system having an output connected to said coolant input to provide cooling to the vacuum tube system.

13. A vacuum tube for handling an r.f. signal having a predetermined frequency range comprising:

a cathode for emitting a linear electron beam;

a grid comprised of non-electron emissive material for current modulating the beam, the grid being positioned from the cathode no farther than a distance in which electrons emitted from the cathode can travel in a quarter cycle of the r.f. signal;

an anode for accelerating the beam, an electrode for collecting the beam, an output cavity, resonant to a frequency of the r.f. signal, positioned between the grid and electrode for collecting the beam;

a coupler responsive to the r.f. signal connected to the grid and cathode so electrons from the cathode upon passing through the grid and accelerated toward the anode are in bundles in an interaction region between the anode and grid to cause r.f. fields that are responsive to the signal to be derived in the interaction region, and r.f. absorbing material coupled to the interaction region for absorbing the r.f. fields so there is non-regenerative coupling of the r.f. signal to the region and there is heavy loading of the interaction region and formation of a resonant impedance in the interaction region is prevented, the heavy loading by the r.f. absorbing material of the interaction region and absorption of the r.f. fields tended to be generated by the bundled electrons in the interaction region being sufficiently great that there is no need to connect a capacitor or other high frequency low impedance component or circuit in shunt with the interaction region to by-pass the r.f. fields that tend to be generated by the bundled electrons;

a signal source for generating the r.f. signal, said signal source having an output;

a driver for amplifying the r.f. signal, said driver having an input connected to said output of said signal source, and a driver outputs;

a vacuum tube system adapted to receive the vacuum tube and having afirst input connected to said driver output for receiving the r.f. signal, a power input, a coolant input, and a load output;

a load element having an input connected to said load output;

a DC power source having an output connected to said power input; and a cooling system having an output connected to said coolant input to provide cooling to the vacuum tube system.

* * * * *

UNITED STATES PATENT AND TRADEMARK OFFICE

CERTIFICATE OF CORRECTION

PATENT NO. : 5,767,625

DATED : June 16, 1998

INVENTOR(S) : Merrald B. Shrader, Andrew A. Haase

It is certified that error appears in the above-identified patent and that said Letters Patent is hereby corrected as shown below:

---At Col. 2, line 40, replace "gri-danode" with --grid-anode--.

---At Col. 3, line 32, replace "nλ/4between" with --"nλ/4 between--.

---At Col. 3, line 65, replace "meal" with --metal--.

---At Col. 5, line 19, replace "connection" with --connector--.

---At Col. 6, line 1, replace "covered" with --covered with r.f. absorbers 42, preferably ferrite tiles--.

---At Col. 6, line 3, replace "ECCOSORB,™C-RAM FT™" with --ECCOSORB™, C-RAM FT™--.

---At Col. 6, line 37, replace "end" with --end connected to outer conductor 52--.

---At Col. 6, line 39, replace "TEFLONTM" with --TEFLON™--.

---At Col. 8, line 32, replace "metal," with --metal--.

---At Col. 9, line 6, replace "KAPTON" with --KAPTON™--.

---At Col. 11, line 16, replace "144,150" with --144, 150--.

---At Col. 14, line 17, replace "beam:" with --beam;--.

---At Col. 15, line 12, replace "cathode" with --a cathode--.

---At Col. 15, line 12, replace "beam." with --beam;--.

---At Col. 15, line 31, replace "1/2, where 1" with --λ/2, where λ--.

---At Col. 16, line 8, replace "beam." with --beam;--.

---At Col. 16, line 18, replace "beam." with --beam;--.

UNITED STATES PATENT AND TRADEMARK OFFICE

CERTIFICATE OF CORRECTION

PATENT NO. : 5,767,625

DATED : June 16, 1998

INVENTOR(S) : Merrald B. Shrader, Andrew A. Haase

It is certified that error appears in the above-identified patent and that said Letters Patent is hereby corrected as shown below:

---At Col. 17, line 14, replace "outputs;" with --output;--.

---At Col. 18, line 2, replace "outputs;" with --output;--.

---At Col. 18, line 39, replace "1/2" with --$\lambda/2$--.

---At Col. 18, line 40, replace "signal." with --signal,--.

---At Col. 19, line 12, replace "beam." with --beam;--.

---At Col. 19, line 13, replace "beam." with --beam;--.

---At Col. 20, line 13, replace "outputs;" with --output;--.

Signed and Sealed this

Twenty-sixth Day of January, 1999

*Attest:*

*Attesting Officer*

*Acting Commissioner of Patents and Trademarks*